United States Patent [19]

Baldi et al.

[11] 4,002,796

[45] Jan. 11, 1977

[54] CONDITIONING OF POLYOLEFINIC FIBERS FOR USE IN THE MANUFACTURE OF SYNTHETIC PAPER

[75] Inventors: Luciano Baldi, Turin; Emilio Martini, Bologna, both of Italy

[73] Assignee: Montedison S.p.A., Milan, Italy

[22] Filed: Jan. 10, 1975

[21] Appl. No.: 540,164

[30] Foreign Application Priority Data

Jan. 11, 1974 Italy ..... 19329/74

[52] U.S. Cl. ..... 428/375; 428/378; 428/394; 428/516; 427/390 R; 260/897 B

[51] Int. Cl.[2] ..... D06M 15/08

[58] Field of Search ..... 260/897; 428/375, 378, 428/394

[56] References Cited

UNITED STATES PATENTS

| | | | |
|---|---|---|---|
| 3,090,769 | 5/1963 | Coover et al. | 260/897 B |
| 3,226,455 | 12/1975 | Matsubayashi et al. | 260/897 B |
| 3,848,027 | 11/1974 | Forbess et al. | 260/897 B |

FOREIGN PATENTS OR APPLICATIONS

| | | | |
|---|---|---|---|
| 975,918 | 11/1964 | United Kingdom | 260/897 |

*Primary Examiner*—Carman J. Seccuro

[57] ABSTRACT

Polyolefinic fibers for use in the manufacture of synthetic paper are rendered readily water-dispersible by pre-treatment with a hydrophilic polymer which is a condensate of polyvinyl alcohol and aliphatic aldehydes containing from 1 to 6 carbon atoms, which condensates contain from 2 to 8 aldehyde residues per 100 units of polyvinyl alcohol.

7 Claims, No Drawings

CONDITIONING OF POLYOLEFINIC FIBERS FOR USE IN THE MANUFACTURE OF SYNTHETIC PAPER

THE PRIOR ART

It is known that, starting with polyolefins, and in particular with polyethylene or polypropylene, it is possible to obtain microfibers, or fibers, having morphological characteristics rather similar to those of cellulose fibers, and which can be substituted, wholly or partially, for cellulose fibers in the manufacture of paper.

In general, such fibers, which are known as fibrils or fibrides, have a length of from 1 to 50 mm., an average diameter of from 1 to 400 microns, and a surface area (specific surface) larger than 1 $m^2/g$.

A process for obtaining such fibrils or fibrides, and use thereof in the manufacture of semi-synthetic paper are disclosed in the pending application of Paolo Galli et al Ser. No. 335,335 filed Feb. 23, 1973.

According to that process, the fibrils or fibrides are obtained by extruding a solution of the polyolefin at a temperature higher than the boiling point of the solvent and at autogenous or higher pressure into a zone of lower pressure and hitting the extruded solution, at an angle with respect to the direction of extrusion thereof, with a jet of fluid having a temperature lower than that of the extruded solution.

Other methods for obtaining fibrils or fibrides of synthetic polymers suitable for replacing cellulose fibers in the manufacture of paper, or for making paper or paper-like products are disclosed, f.i., in USP 2,999,788 in British Pat. No. 1,262,531 and in German Patent Publications DT-OS No. 1,951,576.5 and DAS No. 1,290,040.

In order to use synthetic fibers successfully in the manufacture of synthetic or semi-synthetic paper having satisfactory homogeneity and strength on conventional paper-making equipment and by conventional paper-making techniques it is essential that the synthetic fibers have a dispersibility in water similar to that of cellulose fibers which, due to their morphology and chemical nature disperse very readily and homogeneously in water.

As is known, the fibrils or fibrides of water-repellent synthetic polymers, such as the polyolefins, are not normally easily dispersed in water. Improvement in the water-dispersibility of the fibrils and fibrides thereof requires a pre-treatment which results in the presence of hydrophilic groups on the surface of the fibrils or fibrides.

Various methods are available for solving the problem, e.g., surface modification of the fibrils or fibrides by chemical treatment, intimate mixing of the polyolefin with surfactants or with polymers containing hydrophilic groups; or surface coating of the pre-formed fibrils or fibrides with hydrophilic polymers.

The method involving coating the synthetic fibrils or fibrides with a hydrophilic polymer has proved preferable in practice. That is because aqueous solutions of hydrophilic polymers are always at least partially colloidal and when an aqueous solution thereof is contacted with the hydrophobic synthetic fibrils having a large surface area a certain amount of the hydrophilic polymer is absorbed on the surfaces of the synthetic fibers and facilitates dispersion of the coated fibers in aqueous media. For commercial scale operations, it is important for the absorption to occur in a short time.

According to German Pat. No. 2,208,555, hydrophilic polymers suitable for coating the synthetic fibers are aminic resins, polyethylenimines, polypyrrolidone and polyamides modified by epichlorhydrin. In Belgian Patent No. 787,060 polyvinyl alcohol is suggested for use as the hydrophilic polymer.

According to the German and Belgian patents, the synthetic fibers are dispersed in an aqueous medium containing the hydrophilic coating polymer and, optionally, solvents and/or binders of various types, and the suspension is converted to paper in accordance with the traditional technology. The Belgian patent also contemplates concentration of the aqueous suspension for transportation and re-dispersion during manufacture of the paper.

THE PRESENT INVENTION

An object of this invention is an improvement in the prior art concerned with improving the water-dispersibility of polyolefinic fibrils or fibrides by coating the same with a hydrophilic polymer whereby there are attained higher absorption kinetics and the fixing of an increased amount of hydrophilic material on polyolefinic fibers from aqueous solutions of the hydrophilic material whereby the velocity of dispersion of the polyolefinic fibers in water is considerably enhanced.

Those and other objects are accomplished by this invention in accordance with which the polyolefinic fibrils or fibrides are treated with an aqueous solution of a hydrophilic material resulting from the condensation (or acetalizing) of polyvinyl alcohol with an aliphatic aldehyde containing from 1 to 6 carbon atoms, which condensation products contain, in the macromolecules, from 2 to 8, preferably from 4 to 6, aldehyde residues per 100 monomeric polyvinyl alcohol units.

The polyvinyl alcohol/aliphatic aldehyde condensates used in the present process and methods for preparing them are known in the patent and technical literature. See, for example, French Pat. No. 850,891 and "Polyvinylalkohole," by F. Kainer, published by F. Enke-Stuttgart, 1949, pp. 63 – 80.

In one method of preparing the condensates, and which has been employed in reducing this invention to practice, polyvinyl alcohol is reacted, for some hours, with between 1% and 10% by weight of the aldehyde based on the polyvinyl alcohol weight, at temperatures preferably below 50° C, in methyl or ethyl alcohol, and subsequently the solid condensation product formed is separated from the reaction mixture by centrifuging.

For achieving the objects of this invention there can be used the condensates of polyvinyl alcohol with formic, acetic, propionic or butyric aldehyde, aldol or mixtures of the same.

The polyolefinic fibers can be effectively coated by dipping them into an aqueous solution of the polyvinyl alcohol/aldehyde condensate having a condensate concentration of 0.01 – 0.1% by weight, a temperature not higher than 100° C, and kept under agitation. Under those conditions, the residence time of the fibers in the solution required to insure effective coating of the fibers with the condensate and rapid dispersion in the aqueous medium may vary from 5 to 30 minutes.

The suspension of coated fibers thus obtained can be used as such to prepare pulps which, on the addition of cellulose fibers, can be converted to semi-synthetic paper. More profitably, the suspensions can be used, after filtration and partial drying, to prepare panels of the polyolefinic fibers which are readily storable and transportable and which are readily dispersible in water at the time of their utilization in paper mills.

The following examples are given to illustrate the invention and are not intended to be limiting. For instance, the polyolefinic fibrils used in the examples were prepared — as described below — by the process disclosed in the pending Galli et al application Ser. No. 335,335 (supra) although, obviously, the invention is not limited to coating the fibrils or fibrides so obtained but can be applied to all fibers based on olefinic polymers however obtained and which are suitable as total or partial replacement for cellulose fibers in the manufacture of paper and paper-like articles.

Preparation of polypropylene fibrils

A 50 l autoclave, provided with heating chamber and stirrer, was fed with 2.3 kg of polypropylene (density = 0.91; melting index = 10; melting point = 170° C; isotacticity index = 94) along with 30 l of n-pentane. The mixture was heated to obtain a solution of the polymer in the n-pentane, under the following conditions:

temperature = 170° C pressure = 20 kg/cm$^2$

Under such conditions, the solution was ejected to the atmosphere, through a circular nozzle having a 2 mm diameter, and was made to collide, at about 1 mm distance from the outlet of the nozzle, with a dry saturated steam jet, coming from a nozzle of 4 mm diameter and arranged at an angle of about 85° to the direction of ejection of the polymeric solution, at an impact speed of about 470 m/sec.

A fibrous product was obtained which, under the optical microscope, proved to be composed of individual fibrils having a length comprised between 3 and 5 mm and an apparent (average) diameter of about 10 microns; their surface area (specific surface) was 5 m$^2$/g.

Preparation of polyethylene fibrils

By using the same apparatus as was used to obtain the polypropylene fibrils, polyethylene fibrils were prepared starting from a solution of 3 kg of polyethylene (melting index = 5, melting piint = 135° C, density = 0.95) in 35 l of n-hexane, kept under the following conditions;

temperature = 180° C pressure = 9 kg/cm$^2$, using, as disrupting fluid, dry saturated steam under the same conditions and according to the same modalities as described for the preparation of the polypropylene fibrils. The polyethylene fibrils thus obtained, had a length ranging from 3 to 5 mm, an apparent diameter of about 10 microns and a surface area of 7 m$^2$/g.

EXAMPLE 1

10 g of polyvinyl alcohol, having a hydrolysis degree = 98–100 and a Hoeppler viscosity, at 20° C in a 4% aqueous solution, equal to 22 – 28 cP, were mixed with 70 g of methyl alcohol and the resulting mixture was acidified with 0.2 g of concentrated sulphuric acid. 0.5 g of butyric aldehyde were then added and the whole was reacted under stirring for about 2 hours at a temperature of approx. 40° C. A polyvinyl alcohol/butyric aldehyde condensate was obtained and separated from the reaction mixture by centrifuging. On analysis, it was found to contain 4.5 aldehyde residues per 100 units of vinyl monomer.

0.59 g of the condensate were dissolved in 2.5 l of water (concentration = 236 ppm) and the solution was heated to 90° C. Under stirring, 50 g of the polypropylene fibrils, prepared according to the process described above, were added to the solution. After 15 minutes, the fibrils were recovered by filtration, and the amount of residual condensate determined on the mother liquors by the method of W. T. Brown et al, Am. Dyestuff. Rep., Sept. 1967, p. 36. The found value is reported in Table I, along with the calculated percentage values of retention (% of fixed condensate/condensate pre-existing in the bath) and of the condensate amount fixed on the fibrils.

EXAMPLE 2

A condensate of polyvinyl alcohol and propionic aldehyde having a content of 6 aldehyde residues per 100 vinyl monomeric units was prepared, by operating according to the same modalities as in Example 1 to obtain the butyric derivative, and employing 0.4 g of propionic aldehyde for 10 g of polyvinyl alcohol in the reaction.

By following modalities analogous to those of Example 1 and using an aqueous solution containing 208 ppm of the condensation propionic derivative, 50 g of the polyethylene fibrils prepared as described above were coated. The relevant results are reported in Table I.

EXAMPLE 3

50 g of the polyethylene fibrils were coated by operating under conditions and according to modalities analogous to those of Example 1, but utilizing an aqueous bath containing 390 ppm of the same polyvinyl alcohol/butyric aldehyde condensate. The results obtained are reported in Table I.

EXAMPLE 4

50 g of the polyethylene fibrils were coated by operating under conditions and according to modalities analogous to those of Example 1, but utilizing an aqueous solution containing 240 ppm of polyvinyl alcohol/-butyric aldehyde condensate containing in the macromolecule 4.2 aldehyde residues per 100 vinyl monomeric units. The results obtained are reported in summarizing Table I.

EXAMPLE 5 (comparative)

0.55 g of polyvinyl alcohol having a hydrolysis degree = 98–100 and a Hoeppler viscosity (measured in a 4% aqueous solution at 20° C) = 22–28 cP, were dissolved in 2.5 l of water.

The solution, containing 220 ppm of polyvinyl alcohol, was heated to 90° C and, under stirring, 50 g of the polyethylene fibrils obtained as described above were added thereto. After 15 minutes the fibrils were recovered by filtration. The results are reported in Table I.

EXAMPLE 6 (comparative)

Comparative Example 5 was repeated, but using an aqueous solution containing 400 ppm of polyvinyl alcohol. The results are reported in Table I.

EXAMPLE 7 (comparative)

Operating as in comparative Example 5, but using 0.59 g of polyvinyl alcohol as such (having a hydrolysis degree = 86–89 and a Hoeppler viscosity in a 4% aqueous solution at 20° C = 22–28 cP) in 2.5 l of water (concentration = 236 ppm). The results are reported in Table I.

TABLE I

| | Examples | | | | | | |
|---|---|---|---|---|---|---|---|
| | 1 | 2 | 3 | 4 | 5 | 6 | 7 |
| Bath temperature (° C) | 90 | 90 | 90 | 90 | 90 | 90 | 90 |
| Time required by the fibers treatment (min.) | 15 | 15 | 15 | 15 | 15 | 15 | 15 |
| Initial concentration of the modifier in the bath (ppm) | 236 | 208 | 390 | 240 | 220 | 400 | 236 |
| Final concentration of the modifier in the bath (ppm) | 110 | 67 | 215 | 77 | 180 | 363 | 142 |
| Retention (%) | 53.4 | 67.8 | 44.9 | 68 | 18.2 | 9.3 | 39.9 |
| Fixed modifier per 100 g of fibers (g) | 0.62 | 0.66 | 0.90 | 0.81 | 0.19 | 0.18 | 0.47 |

We claim:

1. In the process of rendering polyolefin fibers having a surface area greater than 1 $m^2/g$ dispersible in water which comprises treating said polyolefin fibers with an aqueous solution of a hydrophilic polymer, the improvement characterized in that the hydrophilic polymer is a condensation product of polyvinyl alcohol with an aliphatic aldehyde having from 1 to 6 carbon atoms which condensation product contains, in the macromolecule, from 2 to 8 aldehyde residues per 100 vinyl monomeric units.

2. The improvement according to claim 1, further characterized in that the polyvinyl alcohol/aliphatic aldehyde condensate contains, in the macromolecule, from 4 to 6 aldehyde residues per 100 vinyl monomeric units.

3. The improvement according to claim 1, further characterized in that the hydrophilic polymer is a condensation product of polyvinyl alcohol and propionic aldehyde.

4. The improvement according to claim 1, further characterized in that the hydrophilic polymer is a condensation product of polyvinyl alcohol and butyric aldehyde.

5. Polyolefin fibers having a surface area greater than 1 $m^2/g$ and, having fixed thereon a hydrophilic polymer which renders the fibers readily dispersible in water, by treating said fibers with an aqueous solution of said hydrophilic polymer which is a condensation product of polyvinyl alcohol and an aliphatic aldehyde containing from 1 to 6 carbon atoms, said condensate containing, in the macromolecule, from 2 to 8 aldehyde residues per 100 vinyl monomeric units.

6. Polyethylene fibers according to claim 5.

7. Polypropylene fibers according to claim 5.

* * * * *